US011287237B1

(12) United States Patent
Pirozzi et al.

(10) Patent No.: US 11,287,237 B1
(45) Date of Patent: Mar. 29, 2022

(54) ELECTRONIC SETBACK DETECTION METHOD FOR 40 MM MUNITIONS

(71) Applicant: U.S. Government as Represented by the Secretary of the Army, Dover, NJ (US)

(72) Inventors: John Pirozzi, Holmdel, NJ (US); Lloyd Khuc, Wharton, NJ (US); Daniel Altamura, Budd Lake, NJ (US); Lei Zheng, Morris Plains, NJ (US); William Leach, Columbia, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/010,974

(22) Filed: Sep. 3, 2020

(51) Int. Cl.
*F42C 15/24* (2006.01)
*F42C 15/40* (2006.01)

(52) U.S. Cl.
CPC ..... *F42C 15/24* (2013.01); *F42C 15/40* (2013.01)

(58) Field of Classification Search
CPC ..... F42C 11/02; F42C 15/24; F42C 15/40
USPC ..... 102/210, 247
See application file for complete search history.

(56) References Cited

U.S. PATENT DOCUMENTS

| | | | | |
|---|---|---|---|---|
| 2,991,716 | A * | 7/1961 | Israel | F42C 11/02 102/210 |
| 3,785,292 | A * | 1/1974 | Bendler | F42C 11/02 102/210 |
| 5,269,223 | A * | 12/1993 | Mattsson | F42C 11/02 102/210 |
| 9,625,243 | B1 * | 4/2017 | Haddon | F42C 11/02 |
| 10,234,248 | B1 * | 3/2019 | Hoang | F42C 11/02 |
| 11,031,607 | B2 * | 6/2021 | Rastegar | H02N 2/181 |
| 2006/0033406 | A1 * | 2/2006 | Rastegar | F42C 11/02 310/339 |
| 2017/0040619 | A1 * | 2/2017 | Rastegar | H02N 2/18 |
| 2019/0003810 | A1 * | 1/2019 | Rastegar | F41B 9/0021 |

* cited by examiner

*Primary Examiner* — Bret Hayes
(74) *Attorney, Agent, or Firm* — John P. DiScala

(57) ABSTRACT

In a projectile launch environment, a fuzing safety device independently generates its own voltage upon setback which then is then used to arm the projectile. The arming is done independently of any on board battery rise time, and setback scenarios are detected free of false impacts such as dropping or jostling. The fuzing safety device includes a piezoelectric sensor for detecting motion in the projectile.

15 Claims, 8 Drawing Sheets

ELECTRONIC SETBACK DETECTION METHOD FOR 40 MM MUNITIONS

U.S. GOVERNMENT INTEREST

The inventions described herein may be made, used, or licensed by or for the U.S. Government for U.S. Government purposes.

BACKGROUND AND BRIEF SUMMARY OF THE INVENTION

The invention provides a solid state electronic solution to detect setback forces on a round in a gun launch environment, even during the early phase when an onboard battery is not yet activated. The detection of setback forces is used in this invention to provide power to arm the fuze circuitry in the round. It is accomplished by bypassing the battery latency time while sensing the setback environment. This is done by storing electrical energy generated from a setback environment onto a storage capacitor in real time. The process of converting, and storing vibrational energy to electrical energy from a setback environment eliminates issues associated with setback sensing timing error. Such error is a typical occurrence for, e.g., mechanical type setback detectors currently used, such as mechanical zig-zag mechanisms. This invention's approach is by striking a piezoelectric transducer with a mass, and filtering that generated electrical energy of the setback environment through electronic components, then storing the energy onto a storage capacitor. This allows for a more accurate response of a setback environment. The way that a setback versus a false reading 'drop' environment is sensed can also be vastly improved. The new results and advantages of the invention are higher reliability, smaller volume due to no general mechanical parts in the setback detector. There is greater versatility for designing the setback detector to sense low and high acceleration munition rounds in a setback environment, there are faster response times for detecting setback, and the invention has the advantage for detecting a setback or drop environment based on frequency, and force response.

OBJECTS OF THE INVENTION

Accordingly, it is an object of the present invention to provide an all electronic launch setback force detection means which may be effectively used for arming an ammunition round fuze means upon launch.

Another object of the present invention is to provide an all electronic launch setback force detection means which does not require separate operating battery power to be in force at the time of launching.

It is yet another object of the present invention to provide an on board all electronic launch setback force detection means (but one which will effectively screen out false launch, or drop, e.g., conditions) and which may be effectively used for arming an ammunition round fuze means upon launch.

It is a further object of the present invention to provide an on board launch setback force detection means which may be effectively used for arming an ammunition round fuze means upon launch, but which does not rely on current all mechanical means for detecting the launch setback forces.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION OF THE INVENTION

Figure 1:
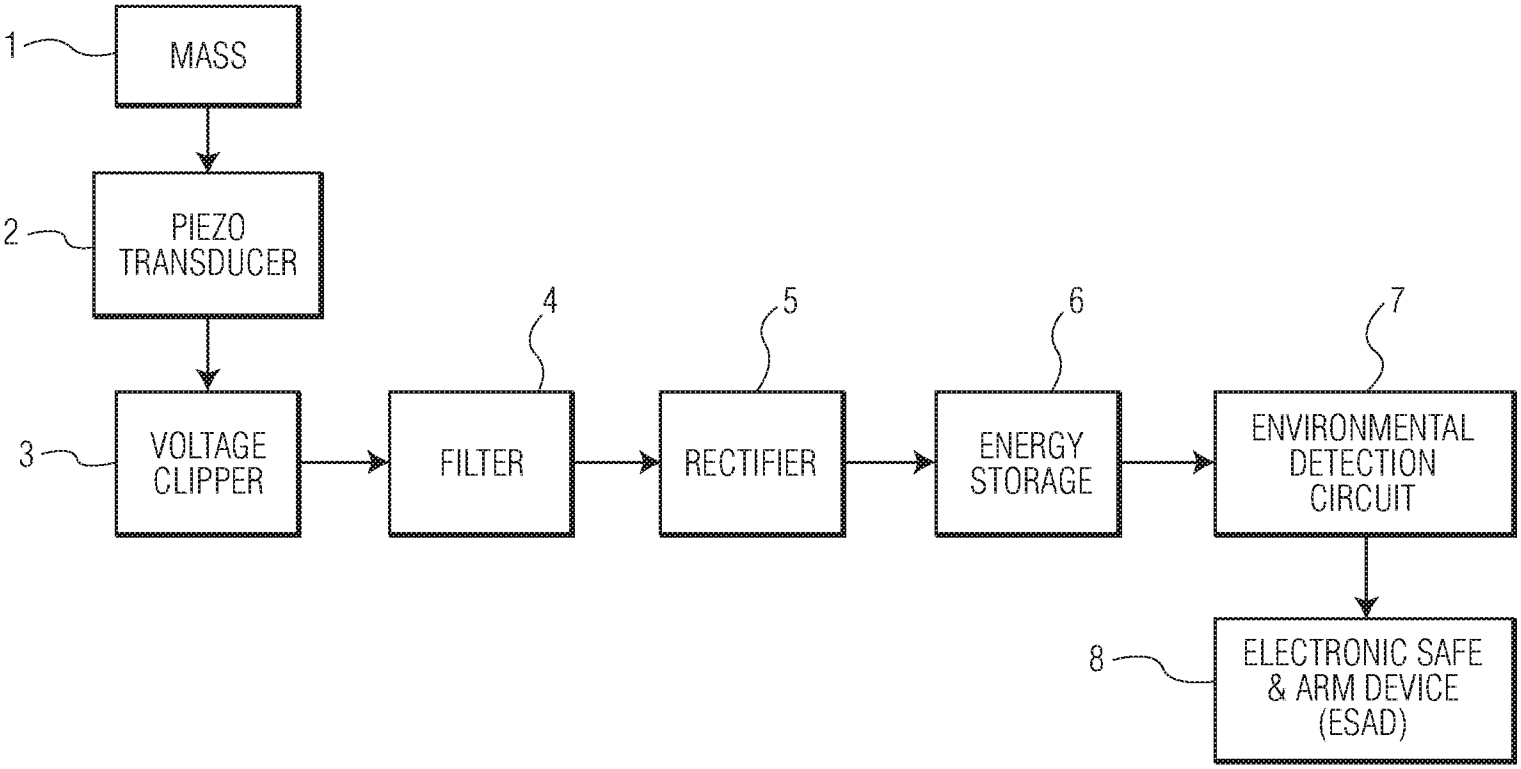
FIG. 1 is a block diagram of an electronic launch setback force detection system used for arming an ammunition round fuze in accordance with this invention.

FIG. 1 shows a block diagram of a setback force detection system according to this invention. Shown there are a mass 1, a piezoelectric sensor 2, a voltage clipper circuit 3, a filter circuit 4, a rectifier circuit 5, an energy storage circuit 6, an environmental detection circuit 7, and an Electronic Safe and Arm Device (ESAD) 8. Element 1 is a mass which rest on top of element 2, a piezoelectric sensor that localizes, and constrains that amount of force applied by the mass to the round at the piezoelectric sensor center based on the reference acceleration profile exerted onto the piezoelectric sensor. Element 2 piezoelectric sensor is a cylindrical shape piezoceramic transducer that allows for vertical movement, and movement along the positive and negative Z-axes. The piezoelectric sensor was designed to optimize the forces exerted on its surface by the use of this specific weighted mass. The piezoelectric sensor generates a voltage in relation to the forces applied to it. Element 3 is a voltage clipper circuit to regulate the magnitude of the high voltage amplitudes that are driven from the piezoelectric sensor into the voltage clipper circuit. Element 4 is a filter circuit that can be comprised of a low pass, high pass, bandpass filter, or band reject filter. The filter deciphers between different frequencies responses driven from elements 2, and 3. If the frequency inputted to it is out of range, the filter will block output of the signal from driving further on into the rectifier circuit (element 5). If the signal is in range, the filter will allow the signal to drive the rectifier circuit which allows voltage signals to enter energy storage device (element 6). The circuit 6 stores the energy driven from elements 2-5, by means of a voltage level which can be measured. The energy stored is governed by the general capacitance equation E=0.5*C*V′ 2. If the voltage level stored on the storage capacitor under a setback event exceeds that of a non-setback event (example an unintended drop) it means that a setback event has been recorded. On board element 7—Environmental Detection Circuit (not fully shown here) is one of multiple static condition sensors that senses if the conditions are right to arm the fuze on this round. Previously used zig zag mechanical setback detectors for this function do not comprise elements 2-6, since they detected a setback environment mechanically, rather than electronically. This invention, when referenced to the cylindrical setback switch and planar setback switch, highlights the issues associated with the use of a mechanical setback detector. A mechanical setback detector takes up a considerable amount of volume, is prone to mechanical failure such as latching issues that cannot be visually inspected, has reliability timing error issues for detecting setback environments, and has a limitation of only being able to sense a setback environment solely on force. As was mentioned, this invention seeks to limit these variables by providing an electronic means to sense a setback environment. This is based on the electronic setback detector's ability to be configured differently with electronic solid state components customized to meet a setback application end user requirement. The electronic aspect for sensing a setback environment allows high versatility for munition rounds that accelerate at high, and low accelerations. The new results and advantages of the invention are higher reliability, smaller volume due to no mechanical parts used to design the setback detector, greater versatility for designing the setback detector to sense low and high acceleration munition rounds in a setback environment, faster response times for detecting setback, and having the advantage of detecting a setback or drop environment based on frequency, and force response.

The invention solves the following fuze related problems. Fuze safety requires there must be a minimum of three environment safety conditions that are triggered during munition launch before the fuze can arm the warhead. The environmental condition of setback is one of those three post launch environment safety conditions. The battery technology used within fuze circuitry has a latency associated with its activation time in the range of 10 ms-100 ms. The battery latency therefore prohibits the fuzing circuitry from being powered and therefore to sense the setback environment in the time frames involved. A means of detecting a setback environment prior to battery activation is therefore required. This invention provides a solid state electronic solution to detect a setback environment during the phase when the battery is not activated to provide power to the fuze circuitry. This is accomplished by bypassing the battery latency time while sensing the setback environment. This is done by storing the piezoelectric generated energy generated from a setback environment onto a storage capacitor in real time. The process of converting, and storing vibrational energy to electrical energy from a setback environment eliminates issues associated with setback sensing timing error, which is a typical occurrence for setback mechanical detectors currently used. The streamline approach is to strike a piezo transducer with a mass, and drive the energy of the setback environment through electronic components. This will allow the energy to be stored in a capacitor for a more accurate response of a setback environment. The way that a setback versus drop environment is sensed can also be vastly improved. Typical setback mechanical detectors are mechanical devices that comprise a complex arrangement of mechanical parts (for example gears, springs and latches). They sense a setback environment based on force solely which can at times lead to an unreliable detection of a setback. This invention provides a solution to sense a setback environment, and other external environments based on frequency, and force response. Thus the invention seeks to improve on the issues addressed for currently used setback mechanical detectors. The problem of developing an electronic version of a setback detector has existed in the range of 30 years within fuze technology.

Currently, a way to sense a setback environment is by use of mechanical setback detectors. There are several versions of mechanical setback detectors such as a cylindrical setback switch, and a planar setback switch. The cylindrical setback switch utilizes a metal conductive mass that travels toward the base of the switch and rotates as the pin rides through the zig-zag track. Once the mass reaches the bottom of the zig zag track, the mass becomes wedged between to conductive contacts thus latching the mechanical switch, and setting the condition that setback environment has been detected. The planar setback switch comprises a spring, a slider, and a mass with a zig zag feature. When the switch is subjected to a setback environment, the slider will clear the zig-zag stages and the slider contact will overcome the gap above the fixed contacts that are printed on a planar PCB board located inside the housing of the mechanical switch. Upon muzzle exit and removal of the setback environment, the spring will force the slider upward and the latching contact will prevent the slider from clearing the latching gap. These types of mechanical setback detectors, as well as other types that exist, sense a setback environment based on force applied to its mechanical device.

Figure 2:
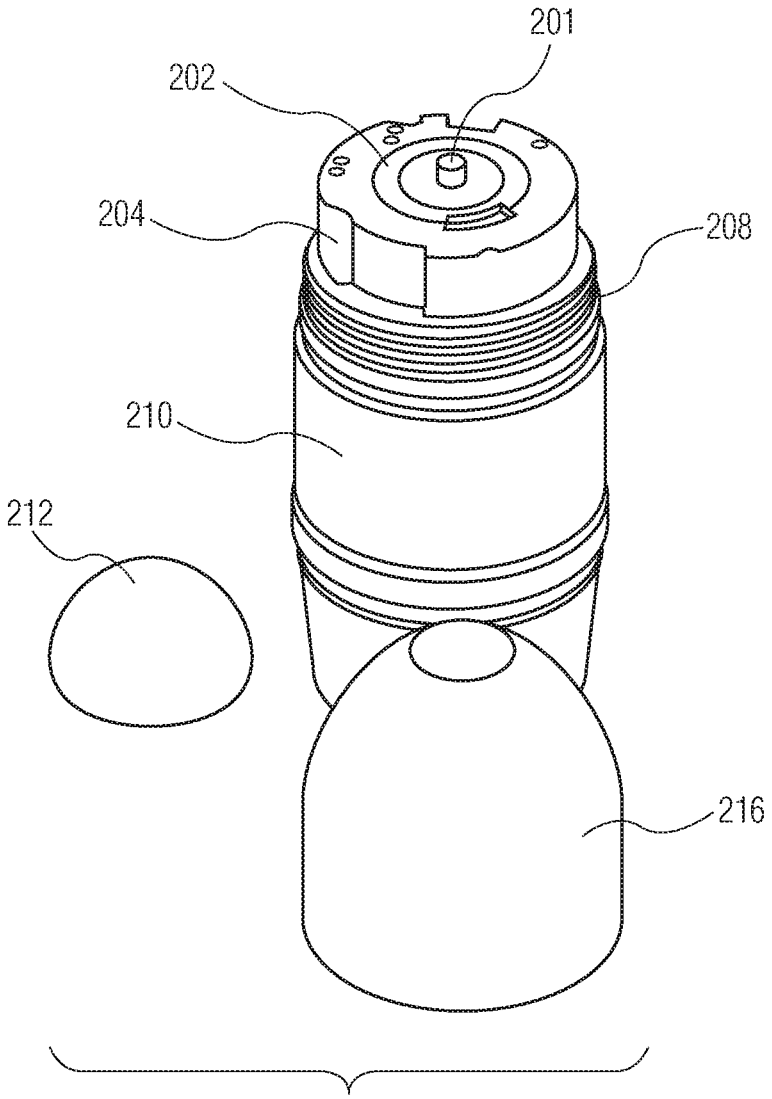
FIG. 2 illustrates a test round with on board recorder 210 which implements this invention utilizing a piezoelectric coin sensor 202 in accordance with this invention.
Figure 8:
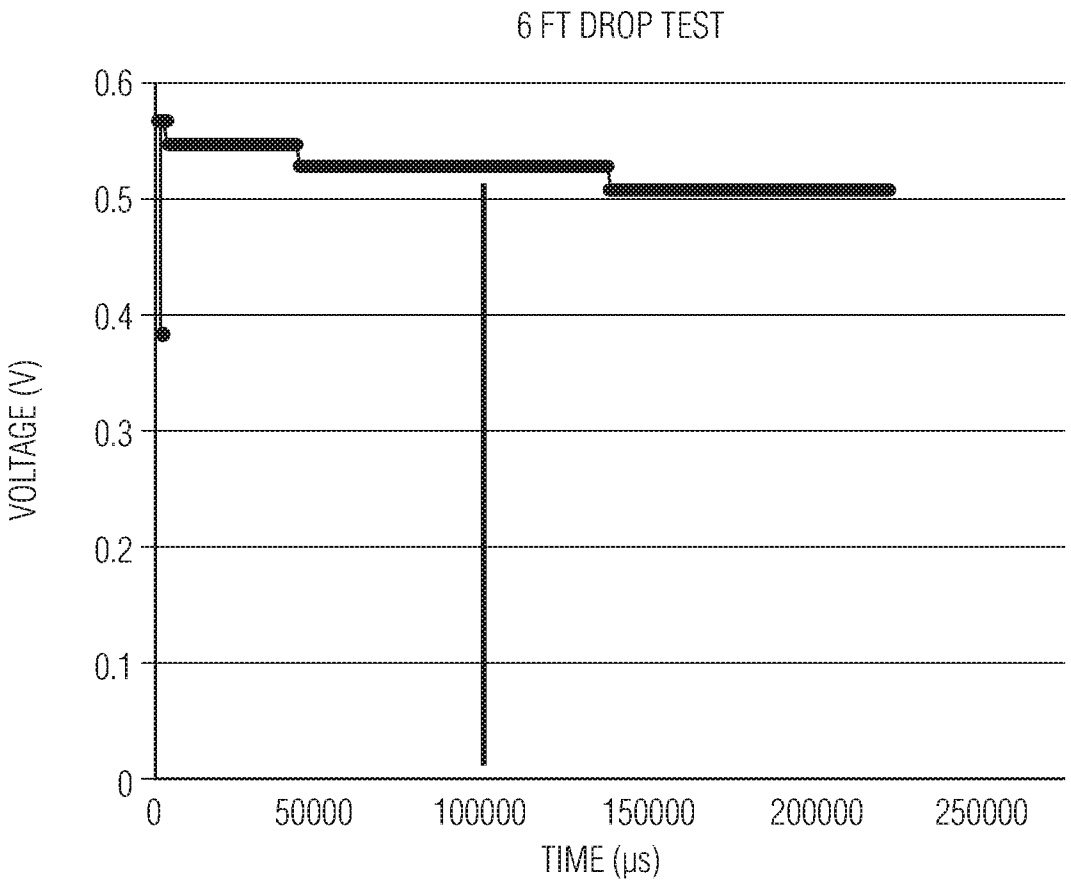
FIG. 8 is a time voltage chart showing outputs from the piezoelectric chip sensor analogous to false launch, 6 foot drop conditions, in accordance with this invention.

FIG. 2 illustrates a test round with on board recorder 210 which implements this invention utilizing a piezoelectric coin sensor 202. The piezoelectric coin sensor 202 could be implemented by a device from Thor Labs, model PA1CEW Piezo Chip, type 45 V, 540 kHz, 65 N (15 lbs.), which may have pre-attached wires thereto. At launch, mass 201 imparts a setback force to the fore of the round which is detected by piezoelectric coin sensor 202. The round has potted on board electronics and detectors 204, retainer 212 covered over by an ogive 216 which may be screwed on to threads 208. Outputs from this piezoelectric coin sensor embodiment are shown in FIG. 8 for a ballistic test (setback forces), whereas as shown in FIG. 9 as for example in a 6 foot drop. For example, this piezoelectric coin sensor embodiment outputted about 1.2 volts after about a tenth of a second (100,000 microseconds) in a real launch, set back situation, whereas for a drop of 6 feet a voltage of only 0.1 volts was being output at the same time (100,000 microseconds), and at no point were more than about 0.25 volts ever being generated by this coin sensor. Thus, it can be seen that this device will distinguish a real launch situation from a mere drop (or jostling) situation.

Figure 3:
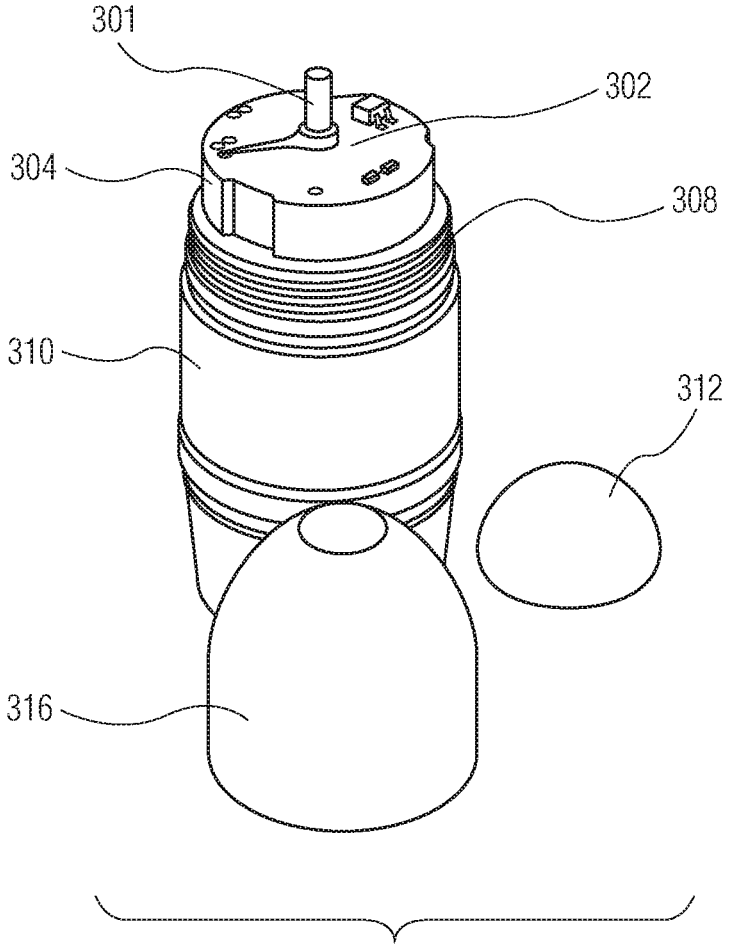
FIG. 3 illustrates a test round with on board recorder 310 which implements this invention utilizing a piezoelectric chip sensor 302 in accordance with this invention.

FIG. 3 illustrates a test round with on board recorder 310 which implements this invention utilizing a piezoelectric chip sensor 302. The piezoelectric chip sensor 302 could be implemented by a component from CUI Devices, model CEB-20D64, 6.5 kHz Standard Buzzer Element, 30V p-p, 350 Ohm. At launch, mass 301 imparts a setback force to the fore of the round which is detected by piezoelectric chip sensor 302. The round also has potted on board electronics and detectors 304, and a retainer 312 covered over by an ogive 316 which may be screwed on to threads 308. Outputs from this piezoelectric chip sensor embodiment are shown in FIG. 71-0 for a ballistic test (setback forces), whereas as shown in FIG. 8 as for example in a 6 foot drop. For example, this piezoelectric chip sensor embodiment outputted about 1.64 volts after about a tenth of a second (100,000 microseconds) in a real launch, set back situation, whereas for a drop of 6 feet a voltage of only about 0.53 volts was being outputted at the same time (100,000 microseconds), and at no point were more than about 0.55 volts ever being generated by this chip sensor. Thus, it can be seen that this device will distinguish a real launch situation from a mere drop (or jostling) situation.

Figure 4:
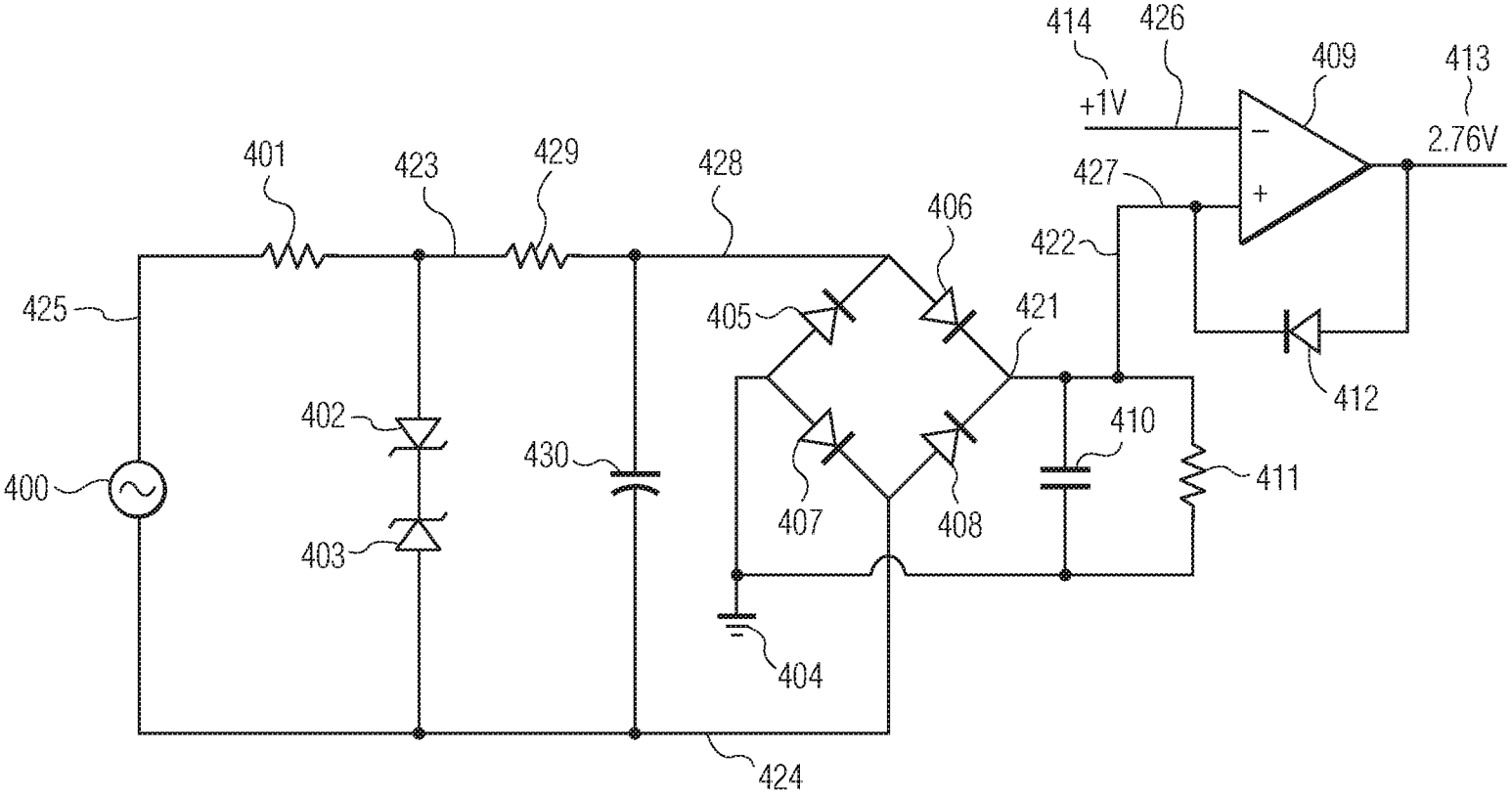
FIG. 4 illustrates electronic circuitry implementing this setback detection invention which may installed on board an ammunition round in accordance with this invention.
Figure 5:
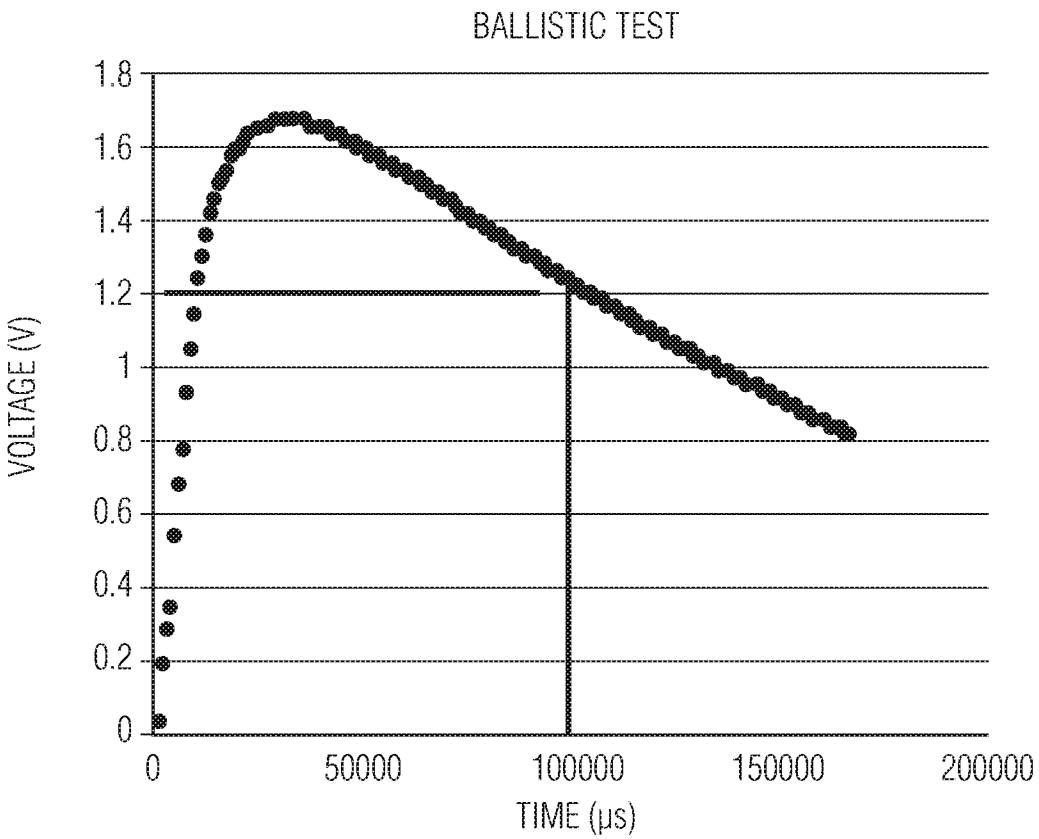
FIG. 5 is a time voltage chart showing outputs from the piezoelectric coin sensor analogous to launch conditions with expected setback forces generated, in accordance with this invention.
Figure 6:
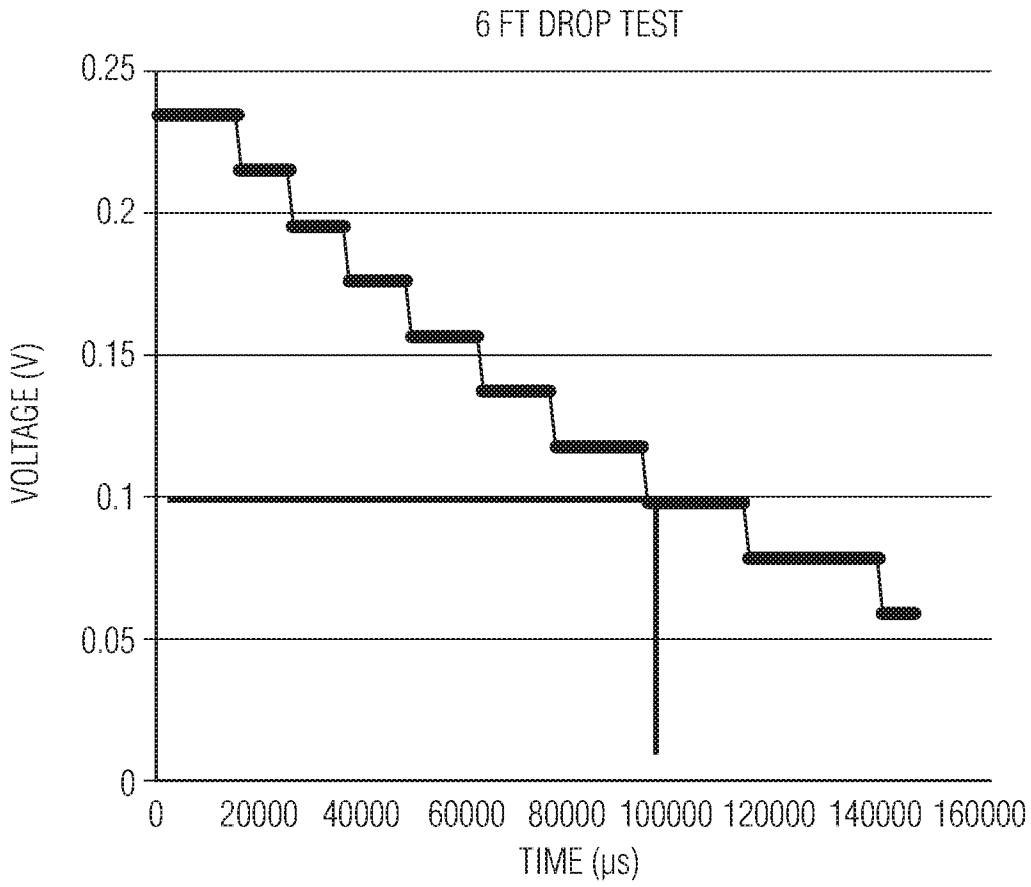
FIG. 6 is a time voltage chart showing outputs from the piezoelectric coin sensor analogous to false launch, 6 foot drop conditions, in accordance with this invention.
Figure 7:
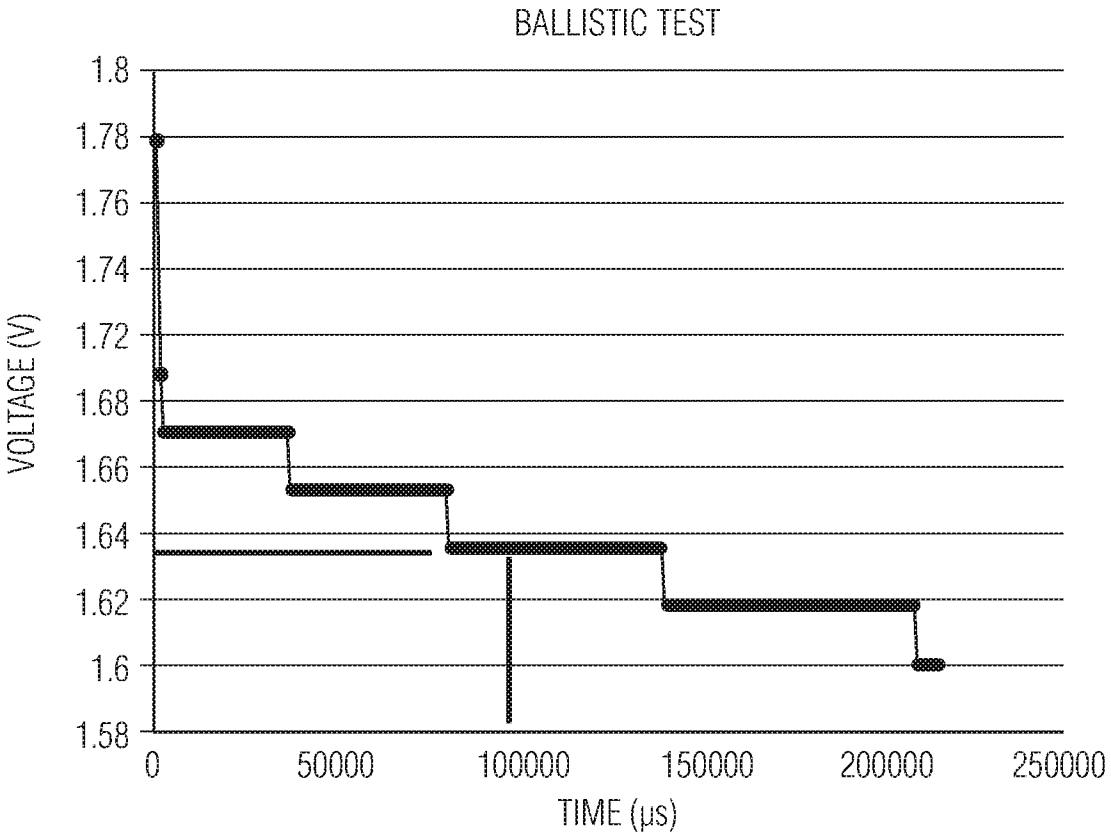
FIG. 7 is a time voltage chart showing outputs from the piezoelectric chip sensor analogous to launch conditions with expected setback forces generated, in accordance with this invention.

FIG. 4 is a simulation circuit for the electronics of the invention which may ultimately be potted and installed on board a round. It substantially implements the electronic circuitry features of this invention. The output of a piezoelectric sensor here may be illustrated by a random pattern voltage source 400 having a 5 volt, 15 Hz, alternating current source being fed through a 10 ohm limiting resistor 401 into a voltage clipper circuit, embodied by opposing zener diode pair 402 and 403. Zener diodes 402 and 403 might be implemented by a component from Diodes Incorporated, model MMBZ5233B-7-F, Zener Diode 6V, 350 mW±5% Surface Mount SOT-23-3. The effect of the voltage clipper circuit is to flatten (limit) the peaks of any waveform coming out of source 400 (simulating the piezoelectric sensor), so the peaks (positively going or negatively going) will not exceed a certain voltage which could destroy the components here in FIG. 4. A low pass filter includes resistor 429 and capacitor 430 and will filter out high frequencies. Diode bridge network 405, 406, 407, 408, grounded at 404, serves as a rectifier network of outputs coming through the voltage clipper circuit and low pass filter. Diodes 405, 406, 407, 408 might be implemented by a component from ON Semiconductor Company, model MDB10S, BRIDGE RECTIFIER, 1P 1 KV 1A 4-MICRODIP. The purpose of the rectifier network is to assure an output signal 421 of only one polarity (positive polarity used in this case) so that output voltage may be fed into parallel capacitor-resistor network 410, 411, grounded at 404. The parallel capacitor-resistor network serves as a voltage storage device for this circuit and is implemented here by a 2 microfarad capacitor in parallel with a 20 megaohm resistor. FIG. 6 shows the voltage in the parallel capacitor-resistor network 410, 411 quickly reaching to about 2.76 volts (this measures what would have been the voltage generated by the mass striking the piezoelectric generator). There is therefore very little loss compared to the 3.3 volts inputted by the source, through these electronics. The 2.76 volts would represent a launch condition with expected setback forces generated. Output 422 of the parallel capacitor-resistor network 410, 411 is next fed to the positive input terminal 427 of a comparator 409. This comparator stage is meant to screen out the false signaling of a mere drop condition which would generate only the lower voltages, here presumed to be under even about 1 volt. A steady+1 volt direct current signal 414 (with respect to ground 404) is fed to the negative terminal 426 of the comparator 409. The output of the comparator exhibits an output signal at 413 (compared to ground 404), and the comparator also has a feedback diode 412 connected from its output signal of 413 back to its positive input terminal 427. Comparator 409 might be implemented by a component: Microchip MCP6541UT, Comparator General Purpose CMOS, Push-Pull, Rail-to-Rail. Diode 412 might be implemented by a component: ON Semiconductor, NSR0140P2T5G, Diode Schottky, 30V, 70 mA. Outputs from circuitry of this device, shown at 413 of FIG. 4, would be analogous to launch condition with expected setback forces generated, but would not generate an output signal at all for a false drop condition (since that voltage would not exceed 1 volt). Here, the comparator exhibits a 4.46 volt output, which according to the FIG. 7 chart shows it occurs at 72.97 milliseconds after an only 5 microsecond ramp up time. So, the simulated FIG. 4 circuitry shown here may provide a good candidate to be installed (potted into) the fuze circuitry, according to this invention. FIG. 5 as was mentioned is a time voltage chart showing outputs from the piezoelectric coin sensor analogous to launch conditions with expected setback forces generated, in accordance with this invention. FIG. 6 as was mentioned is a time voltage chart showing outputs from the piezoelectric coin sensor analogous to false launch, 6 foot drop conditions, in accordance with this invention. FIG. 7 as was mentioned is a time voltage chart showing outputs from the piezoelectric chip sensor analogous to launch conditions with expected setback forces generated, in accordance with this invention. FIG. 8 as was mentioned is a time voltage chart showing outputs from the piezoelectric chip sensor analogous to false launch, 6 foot drop conditions, in accordance with this invention.

While the invention may have been described with reference to certain embodiments, numerous changes, alterations and modifications to the described embodiments are possible without departing from the spirit and scope of the invention as defined in the appended claims, and equivalents thereof.

What is claimed is:

1. In a projectile launch environment, a fuzing safety device configured to generate a first voltage signal (425) upon setback during a projectile launch, without any voltage from an onboard battery device, the fuzing safety device comprising:

a projectile;

a piezoelectric sensor chip (302);

a mass (301) configured to strike the piezoelectric sensor chip (302) to generate the first voltage signal (425);

wherein the first voltage signal (425) is further configured to arm the projectile upon the projectile launch.

2. The fuzing safety device of claim 1, wherein the device is configured to ascertain and discard voltage signals generated by action of non-setback stimulus forces or voltage signals not generated by the piezoelectric sensor chip (302).

3. The fuzing safety device of claim 2 wherein the first voltage signal (425) is configured to arm the projectile through projectile components which comprise a voltage clipper, a filter, a rectifier, an energy storage, and an environmental detection circuit which enables an electronic safe and arm device to arm the projectile.

4. The fuzing safety device of claim 3 wherein the voltage clipper limits peaks in any waveform in the first voltage signal (425).

5. The fuzing safety device of claim 4 wherein the filter eliminates high frequencies from waveforms in the first voltage signal (425).

6. The fuzing safety device of claim 4 wherein the voltage clipper comprises a resistor in series with a pair of opposing zener diodes.

7. The fuzing safety device of claim 5 wherein waveforms in the first voltage signal (425) are limited to all be only of the same polarity.

8. The fuzing safety device of claim 5 wherein the filter comprises a low pass filter which includes a resistor and a capacitor in series.

9. The fuzing safety device of claim 7 wherein voltage outputs from the rectifier are accumulated in the energy storage.

10. The fuzing safety device of claim 7 wherein the rectifier comprises a grounded quadruple diode bridge circuit.

11. The fuzing safety device of claim 9 wherein the environmental detection circuit enables the electronic safe and arm device to arm the projectile only when levels in the energy storage are at a predetermined value.

12. The fuzing safety device of claim 9 wherein the energy storage comprises a resistor in parallel with a capacitor.

13. The fuzing safety device of claim 11 wherein the environmental detection circuit comprises a comparator.

14. In a projectile launch environment, a fuzing safety device configured to generate a voltage signal upon setback during a projectile launch, without any voltage from an onboard battery device, the fuzing safety device comprising:

a projectile;

a piezoelectric coin sensor (202);

a mass (201) configured to strike the piezoelectric coin sensor (202) to generate said voltage signal;

wherein said voltage signal is further configured to arm the projectile upon the projectile launch.

15. The fuzing safety device of claim 14, wherein the device is configured to ascertain and discard voltage signals generated by action of non-setback stimulus forces or voltage signals not generated by the piezoelectric coin means (202).

* * * * *